United States Patent [19]

Alticosalian

[11] 4,006,841

[45] Feb. 8, 1977

[54] PERFUME DISPENSER

[76] Inventor: Girair Hagop Alticosalian, 27 Beaufort Road, Ealing, W.5., England

[22] Filed: July 14, 1975

[21] Appl. No.: 595,799

[30] Foreign Application Priority Data

July 24, 1974 United Kingdom ..... 32752/74

[52] U.S. Cl. ..... 222/42; 222/48; 222/135; 222/144.5; 222/145

[51] Int. Cl.[2] ..... B67D 5/22; B67D 5/60

[58] Field of Search ..... 222/132, 135, 144.5, 222/145, 42, 48

[56] References Cited

UNITED STATES PATENTS

| | | | |
|---|---|---|---|
| 3,211,343 | 10/1965 | Silver | 222/144.5 |
| 3,269,605 | 8/1966 | Silver | 222/144.5 X |
| 3,297,209 | 1/1967 | Pungitore | 222/145 X |
| 3,298,611 | 1/1967 | Marraffino et al. | 222/144.5 |
| 3,596,802 | 8/1971 | Feldman | 222/144.5 |
| 3,718,234 | 2/1973 | Bagguley | 222/144.5 |

*Primary Examiner*—Allen N. Knowles
*Attorney, Agent, or Firm*—Brisebois & Kruger

[57] ABSTRACT

A perfume dispenser which enables any of a plurality of different liquid perfumes to be selected or to be selectively mixed prior to being dispensed, whereby a plurality of different perfume fragrances can be obtained from the dispenser, as desired. The perfume dispenser comprises a holder for holding a plurality of perfume containers, each containing a liquid perfume of a different fragrance, a selector device which enables liquid perfume from any one or from a combination or combinations of the containers to be selected for dispensing through an outlet of the dispenser and an actuating means operable to cause the release of a quantity of the selected liquid perfume or perfumes into a mixing chamber and from said chamber to said outlet.

6 Claims, 3 Drawing Figures

Fig.1
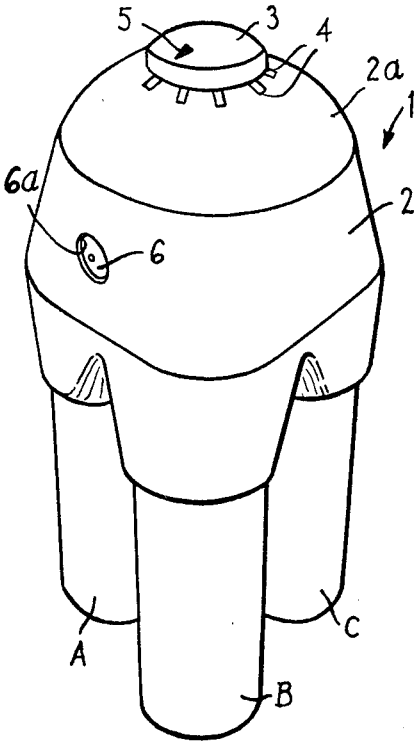
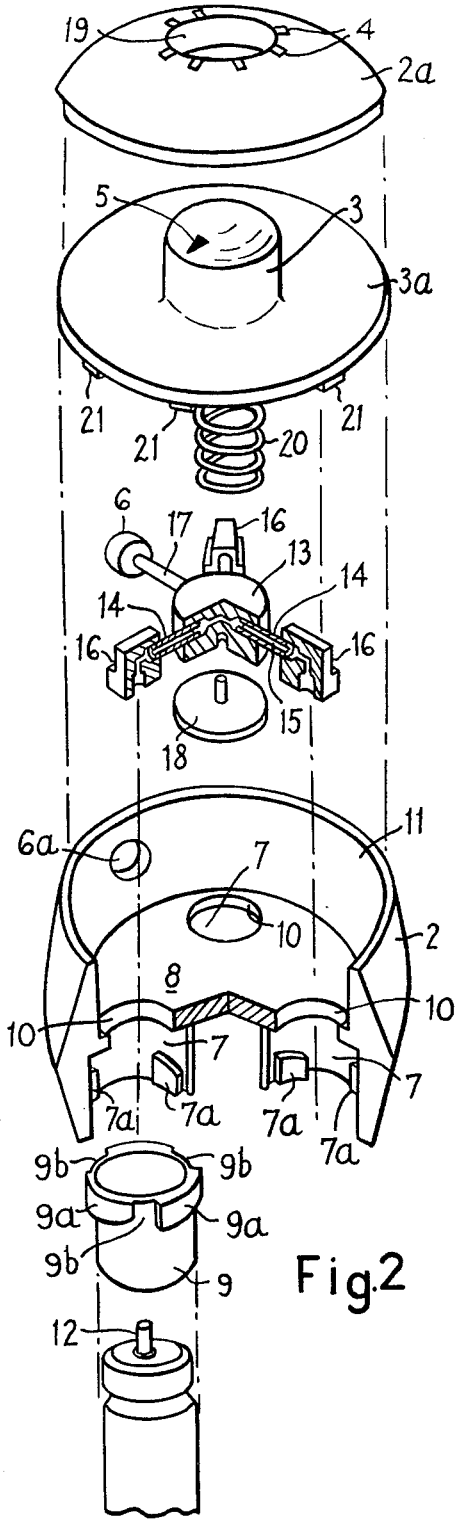
Fig.2
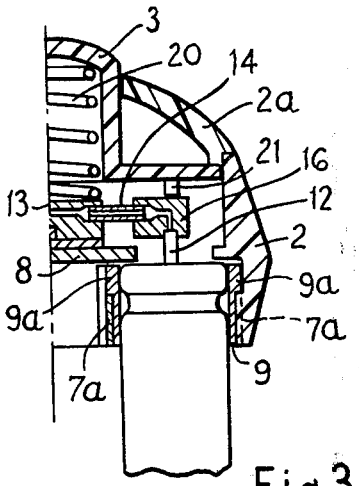
Fig.3

PERFUME DISPENSER

The present invention relates to a perfume dispenser and more particularly to a perfume dispenser which enables any of a plurality of different liquid perfumes to be selected or to be selectively mixed prior to being dispensed, whereby a plurality of different perfume fragrances can be obtained from the dispenser, as desired.

According to the present invention, a perfume dispenser comprises a holder for holding a plurality of perfume containers each containing a liquid perfume of a different fragrance, a selector device which, when the plurality of containers are located in the holder, enables liquid perfume from any one or from a combination or combinations of the containers to be selected for dispensing through an outlet of the dispenser and an actuating means operable to cause the release of a quantity of the selected liquid perfume or perfumes into a mixing chamber and from said chamber to said outlet.

Preferably the selector device is a rotatable member which is rotatable relative to the holder and thereby enables selection to be achieved by rotation of the member to different predetermined positions.

The actuating means may comprise a series of projections, such as pegs, which may be operated, e.g. by a push-button, so as to actuate an outlet valve on one or more perfume containers, dependent upon the selection made, so as to release liquid perfume from the selected container or containers via the mixing chamber for ejection as a spray or mist from the outlet of the dispenser.

According to one embodiment of the invention, the selector device is combined with the actuating means in the form of a rotatable push-button which is rotated to effect the desired selection and which is provided with a peripheral flange carrying the pegs or other projections. Thus, when the push-button is depressed, the appropriate one or ones of the pegs or projections is also depressed to engage with the outlet valves of the selected container or containers to cause the selected perfume or perfumes to be dispensed.

Advantageously the mixing chamber is located below the push-button and is connected by passages to the outlet valve of each of said containers and also to the outlet of the dispenser, in the form of a nozzle carried by a wall of the holder. The connection between each tubular passage and the outlet valve of a container may be effected by means of a union member attached both to the adjacent end of the tubular passage and fitted over the outlet valve.

The invention will now be further described, by way of example, with reference to the accompanying drawings, in which:

FIG. 1 is a perspective view of one embodiment of perfume dispenser according to the invention, FIG. 2. is an exploded view, partly in section, of the perfume dispenser shown in FIG. 1 but in which only one perfume container has been shown for the sake of clarity, and FIG. 3 is a view of a portion of the perfume dispenser of FIG. 2 showing certain of the parts in assembled relationship.

Referring to the drawings, particularly FIG. 1, a perfume dispenser generally indicated at 1 comprises a holder 2, which may be moulded from a plastics material, and which is adapted to hold and locate a plurality of pressurised containers for liquid perfume essences; three such containers A, B and C being shown in this embodiment. It will however be understood that the dispenser may be designed to incorporate only two such containers, or may incorporate more than three such containers, as desired. The perfume containers are of a type well-known in the art which contain a liquid perfume essence under pressure and incorporate a pressure-operated outlet valve which, when it is pressed, causes a spray or mist of a perfume essence contained therein to be ejected through the outlet valve. The containers A, B and C are mounted in the lower part of the holder 2 in the manner described in detail later on. A push-button 3 projects through an aperture in an annular portion 2*a* forming the upper surface of the holder 2. This push-button carries an arrow 5, or similar reference mark, and the annular portion 2*a* carries a plurality of markings 4, (which could be numerals or letters in practice) representing different perfume fragrances which can be dispensed from the perfume dispenser. By rotating the pushbutton to bring the arrow 5 opposite a marking 4 representing a selected perfume fragrance, and then depressing the push-button, the selected perfume fragrance is caused to be ejected as a mist or spray through the outlet nozzle 6 in the side wall of the holder 2.

The construction and manner of operation of the dispenser will now be described in greater detail with reference to FIGS. 2 and 3. The lower portion of the holder 2 is provided with three cylindrical recesses 7 located below a partition wall 8, each of which recesses is adapted to receive the upper portion of one of the perfume containers A, B or C. To this end each recess is provided with peripheral projections 7*a* which can engage behind inclined cam surfaces 9*a* provided on a sleeve 9 fitted around the upper portion of each perfume container. A perfume container is held in its recess 7 by pushing it into the recess so that the projections 7*a* pass through the gaps 9*b* between the cam surfaces 9*a* and then rotating the container so that the projections 7*a* engage the cam surfaces 9*a* and locate and lock the container in the recess. In this position, the outlet 12 of the pressure valve on each container projects through a hole 10 in the partition above the associated recess 7, so that the three pressure valve outlets 12 are located in an upper compartment 11 formed in the holder. This compartment accommodates a central mixing chamber 13 from which radially extend three equiangularly spaced flexible tubes 14 each defining a hollow passage 15 communicating with the mixing chamber and which are attached at their outer ends to a union member 16. The union members are shaped so as to fit over the outlets 12 of the pressure valves of the respective containers A, B and C. A further tube 17, forming an outlet from the mixing chamber connects the mixing chamber with the outlet nozzle 6 located in an aperture 6*a* in the side wall of the holder 2.

The mixing chamber 13 is provided with a base part 18 which closes off the chamber 13, which is moulded from a plastics material. Preferably most of the other parts of the dispenser are also formed as mouldings of a plastics material.

The upper surface of the holder 2 is formed by an annular portion or cap 2*a* having a central aperture 19 through which projects the push-button 3 which is provided with a peripheral flange 3*a* located below the cap 2*a*. The push-button 3 is hollow and receives the upper end of a compression spring 20 whose lower end rests on top of the mixing chamber 13. The lower surface of the flange 3*a* of the push-button is provided with a series of downwardly directed peg-like projections 21 formed integrally therewith as part of the moulding of plastics material. Seven such pegs 21 are provided in this embodiment and are so spaced around the periphery of the flange 3*a* that the rotation of the push-button 3 to align the arrow 5 thereon with any of the different predetermined positions defined by the markings 4 of the cap 2*a* positions a different one or combination of the pegs 21 to engage with one or more of the union members 16.

The dispenser as described incorporates the three containers A, B and C each containing a liquid perfume essence of a different fragrance which can be selectively dispensed from the dispenser. Also, any combination of the three basic essences can be dispensed, thereby giving an overall choice of seven different perfume fragrances which can be obtained from the dispenser. Thus, the dispenser can be operated to dispense fragrance A, fragrance B, or fragrance C, fragrance A + B, fragrance A + C, fragrance B + C or fragrance A + B + C.

The manner in which the dispenser operates to achieve this result will now be described. Firstly, as described above, the user rotates the push-button 3 so as to bring the arrow 5 opposite the reference mark 4 corresponding to the selected fragrance, which may be one of the basic perfume essences or a combination of such essences. However, let it be assumed that this is the perfume essence from container B. The rotation of the push-button to this position will bring the peg 21 corresponding to this selected fragrance over the union member 16 connected to the outlet 12 of the pressure valve of container B. In this position, the remaining pegs will not be located over either of the other union members 16. When the push-button 3 is pressed against the action of the spring 20, the operative peg will bear down on the union member thereby flexing the associated tube 14 and depressing the pressure valve of container B to allow the perfume essence therein to be released through the passage 15 in the associated tube 14, through the mixing chamber 13 and outlet passage 17 and ejected from the nozzle 6 of the dispenser as a spray or mist. When the push-button is released the pressure on the outlet valve of container B ceases and delivery of the perfume essence stops. If the push-button is now rotated to select another fragrance, e.g. that corresponding to the combination of the essences in containers A and C, the pegs 21 corresponding to this selection are brought over the union members 16 connected to the outlet valves of the containers A and C. When the push-button 3 is pressed, these union members will be depressed to operate the valves of these containers to release the perfume essences therefrom into the mixing chamber 13 where they will combine and pass through the outlet passage 17 to the outlet nozzle 6 of the dispenser. Similarly rotation of the push-button to any of the other positions causes operation of the outlet valve of each selected container either alone or in combination to dispense the selected fragrance from the dispenser. As soon as the pressure on the push-button 3 is released, the outlet valve of the container or containers which have been operative is automatically closed and the union members 16 are returned to their normal position.

Where essences from two or more containers are mixed, since they are released into the mixing chamber at the same time, the fragrance resulting from the combination of these essences is virtually consistent. It will of course be appreciated that the three basic essences in the containers A, B and C must have fragrances which when combined together also produce acceptable perfume fragrances.

According to a further embodiment, the push-button is made non-rotatable and selection is achieved by providing a rotatable ring member between the push-button and the upper cavity in the holder, this ring member incorporates a central web provided with holes through which selected ones of the pegs projecting from the lower edge of the push-button can project, according to the rotation of the ring member to any of a plurality of predetermined positions to select a desired fragrance. The periphery of the ring member is provided with markings representing the fragrances which again co-operate with a reference mark on the side wall of the holder to define the predetermined positions.

In either embodiment it will be clear that, if desired, the markings representing the different fragrances may be marked on the rotatable part and the reference mark may be marked on the holder.

Whilst particular embodiments have been described, it will be understood that various modifications may be made without departing from the scope of this invention. Thus, the containers for the perfume essences may alternatively be of the type which are only pressurised when the outlet valve is depressed to dispense a quantity of the perfume essence in the container.

I claim:

1. A perfume dispenser comprising:

a holder for holding a plurality of perfume containers, each containing a liquid perfume of a different fragrance, a selector device which, when the plurality of containers are located in the holder, enables liquid perfume from any one or from a combination or combinations of the containers to be selected for dispensing through an outlet of the dispenser, and an actuating means operable to cause the release of a quantity of the selected liquid perfume or perfumes into a mixing chamber and from said chamber to said outlet, wherein said selector device is in the form of a push-button which is rotatable to predetermined angular positions relative to said holder to effect the desired selection and which is provided with a region carrying said actuating means in the form of a series of spaced projections, whereby when the push-button is depressed after the desired selection has been made, the projections are also depressed so that the projection or projections corresponding to the selection made can engage with the outlet valve or valves of the selected container or containers to cause the selected perfume or perfumes to be fed through said mixing chamber and dispensed at said outlet.

2. A perfume dispenser as claimed in claim 1, wherein the mixing chamber is located below the push-button and is connected by flexible passages to the outlet valve of each of the said containers and also to the outlet of the dispenser in the form of a nozzle carried by the holder and in which the connection between each passage and the outlet valve of the associated container is effected by means of a union member attached both to the adjacent end of the passage and fitted over the outlet valve and which can be engaged by a projection, depending upon the angular position of the push-button.

3. A perfume dispenser as claimed in claim 1, wherein the holder is provided with a plurality of cylindrical recesses each adapted to receive said container and wherein each recess is provided with means for locking the container in position in the recess.

4. A perfume dispenser as claimed in claim 3, wherein the locking means comprise peripheral projections on the wall of the recess which can engage with a cam surface provided on a sleeve fitted around the upper portion of the associated container whereby rotation of the container relative to its recess serves to lock it in position.

5. A perfume dispenser as claimed in claim 3, in which the recesses are located below a partition within the holder, provided with an aperture opposite each recess through which can project the valve member of a container.

6. A perfume dispenser comprising:

a holder releasably holding a plurality of perfume containers each containing a liquid perfume of a different fragrance, a selector device in the form of a resiliently loaded push-button which is rotatable relative to said holder and which is associated with indicating means defining predetermined angular positions of rotation thereby to enable selection to be made of any one or of a combination of said perfume containers, a peripheral region to said push-button, said region carrying actuating means in the form of a series of spaced projections, a mixing chamber located in said holder below said push-button and connected by flexible passages, one for each container, to a union member fitted over the outlet valve of each container, an outlet nozzle mounted on said holder and connected to said mixing chamber for ejecting perfume dispensed from the selected container or containers, whereby when said push-button is depressed after a desired selection has been made by rotation of said push-button to the appropriate angular position, the projection or projections corresponding to that selection engage the union member or members and depress the outlet valve or valves of the selected container or containers, to cause the selected perfume or perfumes to be fed through said mixing chamber and ejected from said outlet nozzle.

* * * * *